United States Patent [19]

Weiner

[11] 4,123,839

[45] Nov. 7, 1978

[54] METHOD OF MAKING A LUGGAGE CASE

[75] Inventor: Jay H. Weiner, New Castle, Pa.

[73] Assignee: Airway Industries, Inc., Ellwood City, Pa.

[21] Appl. No.: 819,170

[22] Filed: Jul. 26, 1977

Related U.S. Application Data

[62] Division of Ser. No. 657,956, Feb. 13, 1976, Pat. No. 4,055,239.

[51] Int. Cl.[2] ..... B23P 19/00

[52] U.S. Cl. ..... 29/434; 29/469

[58] Field of Search ..... 29/434, 469; 190/41 R, 190/49, 50, 53, 54

[56] References Cited

U.S. PATENT DOCUMENTS

| | | | |
|---|---|---|---|
| 1,214,876 | 2/1917 | Axelman | 190/50 |
| 1,667,014 | 4/1928 | Snell | 190/54 |
| 2,067,851 | 1/1937 | Lifton | 190/50 UX |
| 2,466,398 | 4/1949 | Droutman | 190/50 UX |
| 3,292,252 | 12/1966 | Reading | 29/434 X |
| 3,557,854 | 1/1971 | Reitzel | 29/434 X |

FOREIGN PATENT DOCUMENTS

| | | | |
|---|---|---|---|
| 1,032,424 | 7/1953 | France | 190/49 |
| 158,755 | 2/1921 | United Kingdom | 190/50 |
| 258,799 | 9/1926 | United Kingdom | 190/50 |
| 317,210 | 8/1929 | United Kingdom | 190/50 |
| 851,184 | 10/1960 | United Kingdom | 190/54 |
| 1,288,078 | 9/1972 | United Kingdom | 190/50 |

*Primary Examiner*—Charlie T. Moon

*Attorney, Agent, or Firm*—Buell, Blenko & Ziesenheim

[57] ABSTRACT

The specification discloses the structure and method of making a light-weight semi-rigid luggage case having a main body portion and a cover portion hinged along one of the mating side edges to enable the cover to swing out and in with respect to the body portion to which it may be locked as by a separable fastener. The body portion and the cover portion each have a semi-rigid supporting frame consisting of a substantially rectangular loop of spring steel wire secured adjacent the outside face thereof. An additional substantially rectangular loop of spring steel wire is supported by a movable flap, attached adjacent the inner edge of the body portion, and is adapted to be swung down inside the body portion to a position between the other two support loops, to provide a central support frame for the body portion as well as a retainer for a liner member of the body portion. The construction enables the parts of the luggage case to be readily assembled and installed by standard sewing machine equipment.

3 Claims, 2 Drawing Figures

Figures 1, 2:
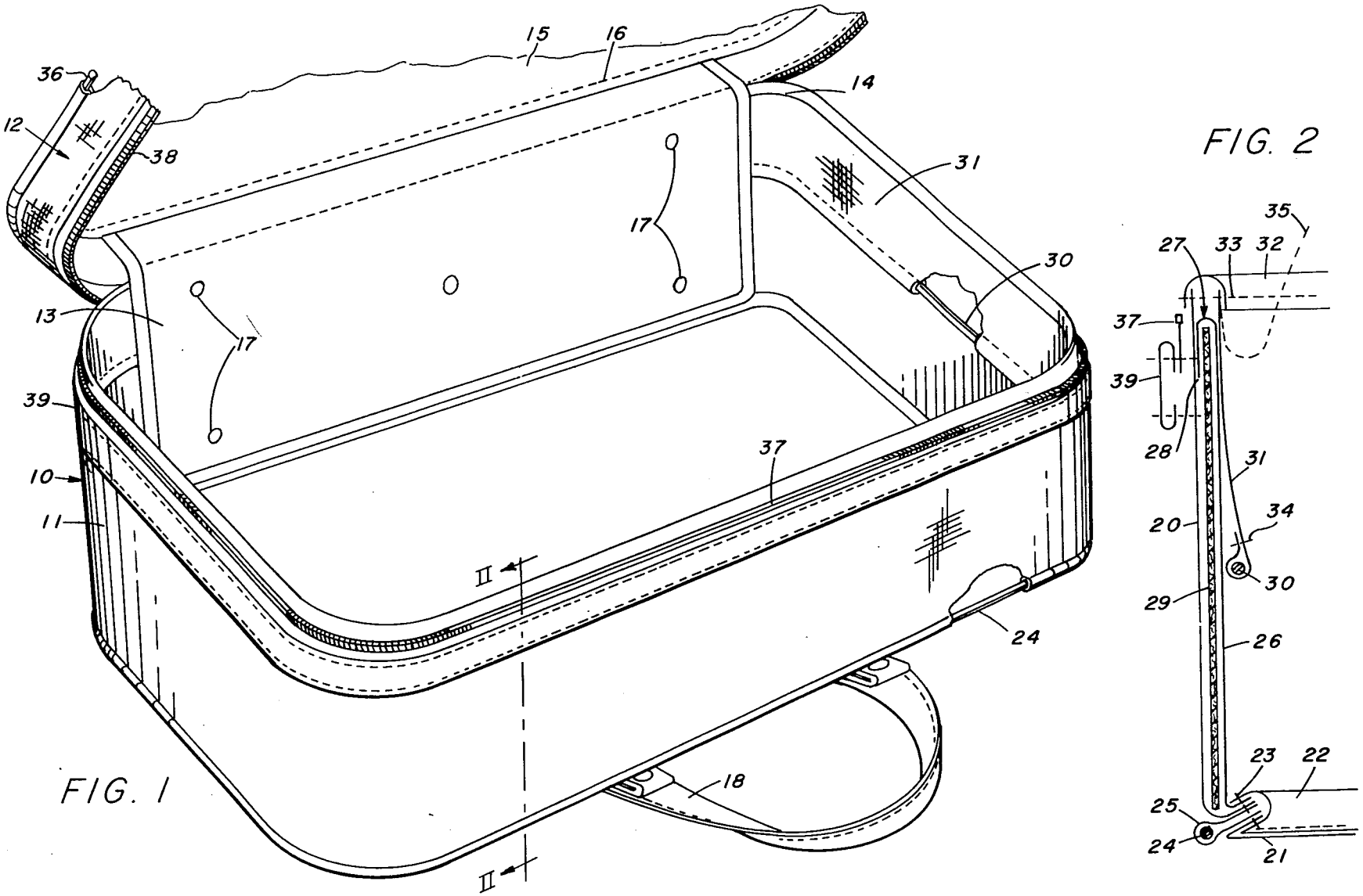

35
32
33
27
37
39
28
20
29
31
34
30
26
23
22
21
25
24

10
11
12
13
14
15
16
17
18
24
30
31
36
37
38
39
II
II

METHOD OF MAKING A LUGGAGE CASE

This is a division of application Ser. No. 657,956 filed Feb. 13, 1976 now U.S. Pat. No. 4,055,239.

This invention relates to luggage cases of the light-weight semi-rigid type having a main body portion and a cover portion swingably hinged together along one edge for opening and closing the luggage case.

Light-weight luggage cases heretofore known have employed a supporting frame for the main body portion made of laminated plywood to provide some degree of rigidity to the case, the sides of the case and the cover being of flexible covering material.

More recently it has been proposed to provide light-weight luggage cases of the semi-rigid type employing a plurality of identically sized rectangular loops of spring steel fixedly secured as by stitching in the main body and cover portions of the luggage case, in parallel relation to provide the degree of rigidity or flexibility desired. The assembly of a plurality of loops of steel wires in parallel relation so as to provide a semi-rigid frame for the luggage case poses certain difficulties primarily with respect to accessibility for machine stitching the intermediate loops of steel wire in the case.

It is the object of this invention to provide a novel construction of luggage case which makes for greater ease of installation and mounting of support wire loops intermediate to the sides of the luggage case.

It is a further object of this invention to utilize the intermediate support wire loops as a means for retaining in place a removable semi-rigid liner member for the walls of the main body.

To obtain the above objects, I provide in a light-weight luggage case of the semi-rigid type, having a main body portion and a cover portion hingedly connected along one edge, a peripheral flap which is folded down interiorly of the walls of the main body portion and in which at least one spring steel wire support loop is attached, as by stitching. The outer edge of the peripheral flap may be secured, as by stitching, to the body portion without interfering with access by sewing machines for the stitching operation.

I further provide a semi-rigid removable liner member, such as fiber or cardboard, which is installed under a fabric interior lining for the wall of the main body, and which is retained in position by at least one of the intermediate support wire loops, when the peripheral flap is folded down interiorly of the wall of the main body of the luggage case.

Other details of the improvements which I provide in a light-weight luggage case of the semi-rigid type will become apparent in the subsequent description thereof when read in connection with the accompanying drawings, wherein:

FIG. 1 is a perspective view, showing in reduced scale a preferred embodiment of my improved luggage case with the cover raised to exhibit the interior of the case, and FIG. 2 is a diagrammatic cross-sectional view on enlarged scale, taken substantially along the line II—II of FIG. 1, showing in exploded manner the relation of the parts constituting the main body portion of the luggage case of FIG. 1.

Referring to the drawings, it will be seen that the embodiment of luggage case 10 shown comprises a main body portion 11 and a cover portion 12, hingedly connected along one edge by a suitably reinforced hinge member 13 of cloth, fiber, plastic or vinyl material. As seen in FIG. 1, the edges of the hinge member are protected or decorated by a binding tape 14 stitched thereto. One end of the hinge member 13 is secured to the interior of the cover portion 12, as by insertion under the sheet 15 of lining material, such as plastic or vinyl coated fabric, and secured by the stitching 16 which extends through the material of which the cover is made. The other end of the hinge member 13 is firmly attached to the peripheral wall of the main body portion 11 as by a plurality of spaced rivets 17. While not visible in the drawing, the rivets 17 may be utilized to secure lugs of rubber or plastic to the outside of the bottom wall of the body portion, on which the luggage case may stand.

The main body portion 11 and the cover portion 12 are each provided with a flexible handle strap 18 of U-shaped configuration, attached at opposite ends to the side faces of the respective portions 11 and 12. Straps 18 are preferably of vinyl or leather material. The two straps, when grasped in one hand provide the handle by which the luggage case may be carried.

Referring now especially to FIG. 2, the cross-sectional construction and method of assembly of my luggage case will be described. Any suitable material may be utilized to constitute the walls and sides of the body portion 11 and cover 12. The drawing shows a cloth like material or fabric of coarse weave such as burlap or linen, the interior side of which has a vinyl or rubberized coating for water-proofing purposes. A single strip 20 of covering material, the ends of which are overlapped and stitched together, constitutes the outer surface of the wall of the body portion. A single piece 21 of covering material is cut to appropriate size to form the outer surface of the side of the body portion 11. A marginal area of the piece 20 and of the piece 21 are secured together as by a tape strip or binding 22 through which threads 23 of stitching extend. A substantially rectangular support wire 24 of spring steel is first covered by wrapping a strip 25 of suitable sheet material, such as vinyl or plastic, around it, the opposite edges of the strip 25 being included with the marginal areas of members 20 and 21 within the tape or binding 22. Also included with the tape or binding strip 22 is a marginal area of a lining 26 of fabric coated with some plastic such as vinyl. To the upper edge of the lining 26 at 27 is stitched a peripheral member 28 of similar material, thereby providing a pocket therebetween at the upper edge thereof by which the lining 26 is supported over the top edge of a semi-rigid member 29. Member 29 is preferably made of fiber or cardboard sheet, approximately one-sixteenth of an inch thick, and extends all the way around the periphery of the luggage case to provide semi-rigid support for the external strip 20 and for the fabric lining 26. From FIG. 2, it will be seen that the member 29 is substantially as wide as the peripheral wall of the luggage case and lies between the outer covering member 20 and the interior lining 26.

In order to lock the lining 26 to the support member 29 and at the same time provide support for mounting an intermediate rectangular support wire 30, I provide a strip 31 of material such as the covering material utilized for the outer surface piece 20, and approximately half the width of piece 20. The one edge of strip 31 is aligned with the top edge of the piece 20 and bound thereto as by a tape or binding 32 and stitching, shown at 33, through the piece 20, strip 31, and the tape 32. The bottom edge is then lapped over the support wire 30 and stitched in place at 34. It will be seen that accessibility for machine stitching at 34 may be provided readily and simply by folding the strip 31, as shown by the dotted line 35, outside the interior of the body portion 11. After the support wire 30 is secured to the edge of the strip 31, the strip may be folded back to its normal position inside the body portion 11 of the case in which the support wire 30 is positioned intermediately of the top and bottom edges of the body portion 11 for providing semi-rigid support for the peripheral wall of the luggage case.

Alternatively, the support wire 30 may be first attached to the strip 31 and then, with the strip 31 and support wire positioned within the interior of the main body portion, attaching the strip to the top edge of the piece 20 by machine stitching through the tape 32.

The cover portion 12 of the luggage case is made and assembled in much the same way as here described for the body portion 11, the depth of the peripheral wall being approximately only one-fourth that of the body portion 11. From FIG. 1, it will be seen that the cover portion 12 is provided with a substantially rectangular support wire 36, which is covered by a strip of vinyl or plastic sheet similar to the covering 25 for the support wire 24. The edges of the strip covering the wire 36 are firmly bound on the interior of the cover portion 12 by a tape and stitching therethrough to the material of which the cover portion is made.

Both the body and cover portions 11 and 12 are respectively provided with cooperating peripheral separable fastener tapes 37 and 38, commonly referred to as a "Zipper". Although not shown in the drawings, the fastener tapes are provided with one or two opening and closing tabs, the latter being preferred.

As seen in FIG. 2, the fabric web of the fastener tape 37 is stitched to the outside periphery of the body portion 11 near the top edge thereof. For decorative purposes, an additional strip 39 of covering material is provided by which to partially hide the cloth web of fastener tape. The edges of the strip 39 are doubled over to avoid unraveling of the edges of the fabric covering material.

The fastener tape 38 is similarly secured interiorly between the outer covering of the cover portion and an inner strip, similar to strip 39, as by stitching.

It will be apparent that the body portion 11 and the cover portion 12 are first each made separately and that the hinge member 13 is then installed as heretofore indicated.

It will be seen that I have provided a luggage case of the semi-rigid type having a novel arrangement whereby to assemble and mount intermediate support wires in the luggage case, and also a method for assembling a luggage case of the semi-rigid type which utilizes a standard type of sewing machine and does not require a highly specialized type of sewing machine designed for the purpose.

I claim:

1. A method for making a luggage case of the lightweight semi-rigid type, comprising the steps of:
   (a) providing a substantially rectangular main body portion having a first support wire loop of spring steel embodied therein,
   (b) providing a substantially rectangular cover portion having a second support wire loop of spring steel embodied therein,
   (c) securing a peripheral flap member along one edge to the inner edge of said main body portion,
   (d) securing a third support wire loop of spring steel along the unsecured edge of the flap member, and
   (e) assembling the cover portion with said main body portion and swinging the flap member to a position interiorly of the main body portion wherein the third support wire loop on said flap member assumes a position intervening in parallel spaced relation between said first and said second support wire loops.

2. A method for making a luggage case of the lightweight semi-rigid type, according to claim 1, comprising the further steps of:
   (a) providing a hinge member of flexible sheet material, and
   (b) attaching said hinge member to said main and cover portions after the said third support wire loop is installed in position between said first and said second support wire loops.

3. A method for making a luggage case of the lightweight semi-rigid type, as recited in claim 1 wherein the step (a) includes
   (1) providing a main body portion having an outer surface of flexible sheet material,
   (2) providing a lining member of sheet material having a pocket formed along one edge,
   (3) attaching said lining member to the main body portion along the edge opposite the pocket,
   (4) providing a semi-rigid support member of sheet material, and
   (5) interposing said semi-rigid support member between the outer surface of flexible sheet material and said lining member of sheet material with a portion thereof extending into the pocket formed along one edge of said lining member.

* * * * *